US007171137B2

(12) United States Patent
Lee et al.

(10) Patent No.: US 7,171,137 B2
(45) Date of Patent: Jan. 30, 2007

(54) DEVELOPING APPARATUS AND IMAGE FORMING EQUIPMENT AND METHOD THEREOF

(75) Inventors: Hyun-cheol Lee, Suwon-si (KR); Jeong-seon Kim, Suwon-si (KR); Valeri Krasnoslobodtsev, Suwon-si (KR); In-cheol Jeon, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 154 days.

(21) Appl. No.: 10/964,617

(22) Filed: Oct. 15, 2004

(65) Prior Publication Data

US 2005/0095028 A1 May 5, 2005

(30) Foreign Application Priority Data

Oct. 30, 2003 (KR) ..... 10-2003-0076212
May 12, 2004 (KR) ..... 10-2004-0033575
Jul. 5, 2004 (KR) ..... 10-2004-0051924

(51) Int. Cl.
*G03G 21/00* (2006.01)

(52) U.S. Cl. ..... 399/98; 399/92; 399/93; 399/99

(58) Field of Classification Search ..... 399/92, 399/93, 98, 99
See application file for complete search history.

(56) References Cited

U.S. PATENT DOCUMENTS 4,361,396 A * 11/1982 Uchida ..... 399/92
5,923,922 A * 7/1999 Ishida et al. ..... 399/98
2001/0010767 A1* 8/2001 Watanabe ..... 399/92
2004/0052545 A1* 3/2004 Satoh ..... 399/92

FOREIGN PATENT DOCUMENTS

| | | |
|---|---|---|
| JP | 58-011969 | 1/1983 |
| JP | 59-170868 | 9/1984 |
| JP | 59-220773 | 12/1984 |
| JP | 60-133478 | 7/1985 |
| JP | 64-38776 | 2/1989 |
| JP | 06-011970 | 1/1994 |
| JP | 06-289697 | 10/1994 |
| JP | 10-3220 | 1/1998 |
| JP | 011-095551 | 4/1999 |
| JP | 11-231652 | 8/1999 |
| JP | 2002-278388 | 9/2002 |

* cited by examiner

*Primary Examiner*—David M. Gray
*Assistant Examiner*—Joseph S. Wong
(74) *Attorney, Agent, or Firm*—Roylance, Abrams, Berdo & Goodman, L.L.P.

(57) ABSTRACT

A method and developing apparatus are provided. The method and apparatus comprise a developing carrier, spaced apart from an image carrier at a predetermined interval, for developing an electrostatic latent image formed on the image carrier during rotation; and a rotational member, rotatably installed adjacent to the image carrier, for generating an air stream reverse to that generated by rotation of both the image carrier and the developer carrier, thereby inhibiting a developer from being scattered.

43 Claims, 12 Drawing Sheets

DEVELOPING APPARATUS AND IMAGE FORMING EQUIPMENT AND METHOD THEREOF

CROSS-REFERENCE TO RELATED APPLICATIONS

This application claims benefit under 35 U.S.C. § 119 from Korean Patent Application Nos. 2004-33575, 2004-51924 & 2003-76212, filed on May 12, 2004, Jul. 5, 2004 & Oct. 30, 2003, respectively, the entire contents of which are incorporated herein by reference.

BACKGROUND OF THE INVENTION

1. Field of the Invention

The invention relates to a developing apparatus and image forming equipment and method thereof. More particularly, the present invention relates to a developing apparatus and image forming equipment and method for preventing a developing agent from contaminating the image forming apparatus.

2. Description of the Related Art

Image forming equipment such as a laser printer, a light emitting diode (LED) printer, a digital copier, a facsimile for general paper, and so on, have a function of transferring an image signal based on an input digital signal to a printing medium, such as a sheet of paper, in a form of a visual image and printing it.

This image forming equipment comprises a developing apparatus, a laser scanning apparatus, a fixing apparatus, and so on.

The developing apparatus includes an image carrier such as a photosensitive drum for developing the visual image, and a developer carrier for transferring a developer such as a toner to the image carrier.

For the image carrier, an electrostatic latent image corresponding to the visual image is formed on a surface of the image carrier by light scanned by the laser scanning apparatus.

In an example of the developer carrier, there is a developing roller used for a non-contact developing mode. The developing roller rotates with a predetermined developing gap separated from the image carrier. The developing roller functions to transfer the developer such as the toner to a region for the electrostatic latent image in the non-contact developing mode. In other words, the developer attached to the developing roller is transferred to the electrostatic latent image region through the developing gap by an electrostatic force caused by a potential difference between the electrostatic latent image and the developing roller. The toner transferred to the electrostatic latent image region is transferred to the printing medium passing between the image carrier and the transferring roller. The printing medium passes through the fixing apparatus. The visual image transferred to the printing medium is fixedly attached to the printing medium by high temperature/pressure at the fixing apparatus.

Meanwhile, as the image carrier and the developing roller rotate each other in a forward direction (i.e. in a direction rotating in engagement with each other), a constant air stream occurs at the developing gap. Further, as the printing medium moves, such an air stream occurs between the printing medium and the developing apparatus.

Particles of the toner, which are transferred from the developing roller to the electrostatic latent image region through the developing gap, are disturbed by the air stream.

In particular, the toner particles lacking in charge are impacted more by the influence of the air stream compared with the electrostatic force, and are not transferred to the electrostatic latent image region. Further, some toner particles are scattered to an interior of the image forming equipment, thus contaminating the interior of the image forming equipment.

SUMMARY OF THE INVENTION

Therefore, the present invention has been developed to overcome the above mentioned problems in the prior art and it is an object of the present invention to provide a developing apparatus and an image forming equipment and method, capable of inhibiting a developer from being scattered.

In order to accomplish this objective, according to one aspect of the present invention, there is provided a developing apparatus and method, comprising: a developing carrier, spaced apart from an image carrier at a predetermined interval, for developing an electrostatic latent image formed on the image carrier during rotation; and a rotational member, rotatably installed adjacent to the image carrier, for generating an air stream reverse to that generated by rotation of both the image carrier and the developer carrier.

Here, the rotational member may be provided on a lower portion of the developer carrier.

The rotational member may rotate in a rotational direction equal to that of the image carrier.

The rotational member may have a rotational linear velocity equal to or greater than that of the image carrier.

The rotational member may include a rotational shaft and at least one rotational blade provided on the rotational shaft.

The rotational member may include a rotational shaft and a rotational roller provided on the rotational shaft.

Further, the rotational member further includes at least one transmission unit to which a driving force is transmitted from the developer carrier.

The transmission units are provided on both ends of the rotational shaft of the rotational member respectively, and include a pair of rotational plates rotating in engagement with an outer circumferential surface of the developer carrier.

The rotational member may be installed to receive a driving force from any one of the image carrier and the developer carrier.

The rotational member may have a linear velocity ranging from about 50% to about 150% compared with that of a surface of the image carrier.

The developing apparatus further may comprise a scattered developer container for containing a scattered developer shifted by the air stream generated by rotation of the rotational member.

The developing apparatus may further comprise a first housing where the developer carrier is installed and a new developer is contained; and a second housing where the image carrier is rotatably supported and a waste developer is contained, wherein the scattered developer container is rotatably disposed on an outer side of the first housing.

The scattered developer container may include a third housing installed on a lower side of the first housing and is provided with an inlet and an outlet.

The outlet of the third housing may be provided with a filter.

The scattered developer container may further include a developer scattering inhibitor for inhibiting the developer introduced into the inlet of the third housing from flowing out to the outlet and storing the inhibited developer.

The developer scattering inhibitor may include at least one adhesive layer provided on an inner wall of the third housing.

The developer scattering inhibitor may include a slant surface inclined upward from a bottom surface of the third housing to the outlet.

The scattered developer container may further include a plate member supported to the third housing, the plate member being installed around a lower portion of the rotational member and being resiliently deformable.

The plate member may be a film comprising polyethylene terephthalate (PET) or urethane.

An interval between the plate member and the rotational member may range from 0 mm to 3 mm or less.

The plate member may have a length extending from the third housing, wherein the length is greater than a radius of the rotational member.

The rotational member may be spaced apart from the image carrier at an interval within about 3 mm.

According to another aspect of the present invention, there is provided an image forming equipment and method. The apparatus and method comprise an image carrier; a developing carrier, spaced apart from an image carrier at a predetermined interval, for developing an electrostatic latent image formed on the image carrier during rotation; and a rotational member, rotatably installed adjacent to the image carrier, for generating an air stream reverse to that generated by rotation of both the image carrier and the developer carrier.

The image forming equipment may further comprise a scattered developer container for containing a scattered developer shifted by the air stream generated by rotation of the rotational member.

The image forming equipment may further comprise a pre-transfer lamp, installed on a lower side of the scattered developer container, for lowering a potential difference between an image region of the image carrier and a non-image region of the image carrier.

The pre-transfer lamp may be mounted on a guide member for guiding a printing medium fed to a lower side of the image carrier.

A sealing member may be provided between the guide member and the scattered developer container.

The image forming equipment may further comprise a film member supported to the scattered developer container so as to be installed on a lower side of the rotational member.

An interval between the film member and the rotational member may range from 0 mm to 3 mm or less.

The film member may have a length extending from the scattered developer container, wherein the length is greater than a radius of the rotational member.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Figure 1:
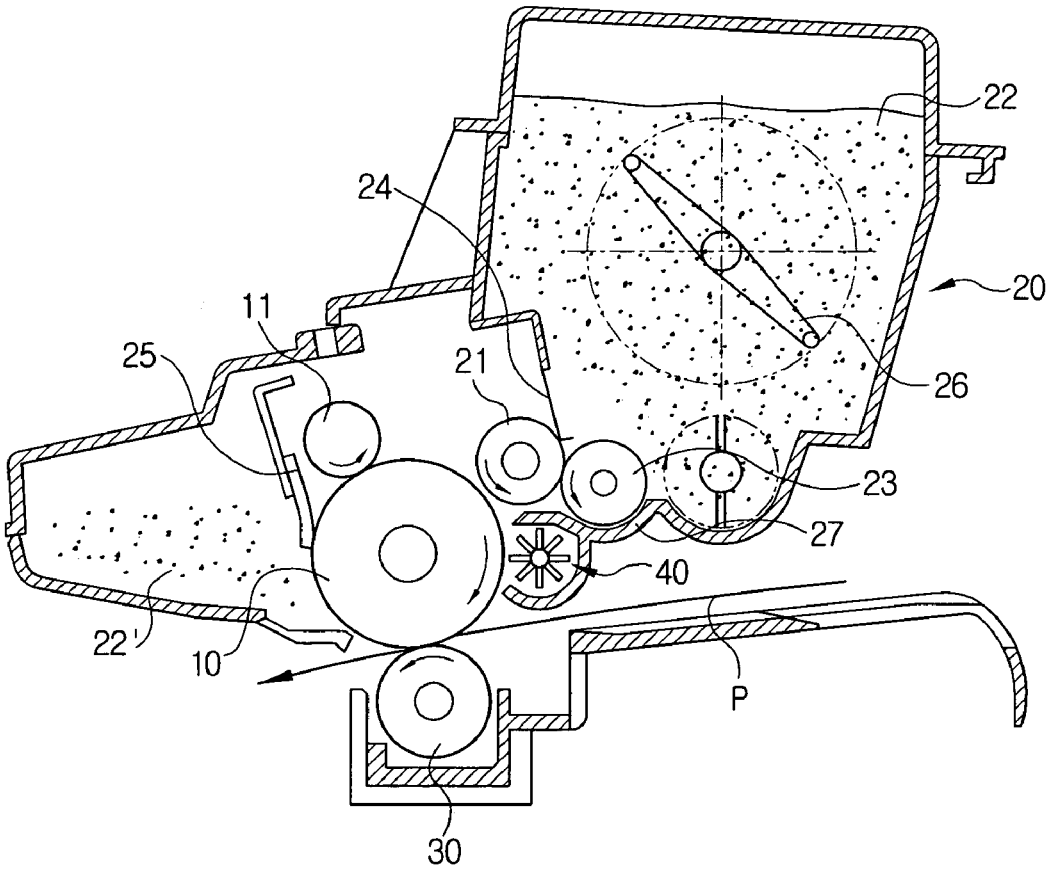
FIG. 1 schematically illustrates a main part of an image forming equipment according to a first embodiment of the present invention.

Hereinafter, a detailed description will be provided for a developing apparatus and image forming equipment having the same according to exemplary embodiments of the invention with reference to the accompanying drawings.

In the following description, the same drawing reference numerals are used for the same elements throughout the drawings. The matters defined in the description such as a detailed construction and elements are exemplary. Thus, it should be apparent that the present invention can be performed without those defined matters. Also, well-known functions or constructions are not described in detail since they would obscure the invention in unnecessary detail.

FIG. 1 illustrates a schematic configuration of an image forming equipment according to a first embodiment of the present invention.

Referring to FIG. 1, the image forming equipment comprises an image carrier 10, a means 11 for charging the image carrier 10 to a predetermined potential, an exposure apparatus (not shown) for scanning light onto the charged image carrier 10 to form an electrostatic latent image in a predetermined shape, a developing apparatus 20 for developing the electrostatic latent image into a toner image, and a transferring unit 30 for transferring the toner image formed on the image carrier 10 to a printing medium P.

The developing apparatus 20 includes a developer carrier 21 for developing the electrostatic latent image formed on the image carrier 10 while rotating a certain distance from the image carrier 10; a supplying roller 23 for supplying the developer carrier 21 with a developer 22 while rotating in the same direction as the developer carrier 21; a regulating member 24, mounted on an upper portion of the developer carrier 21, for regulating a developer layer, which is attached to a surface of the developer carrier 21 by the supplying roller 23, to a constant thickness; and a rotational member 40 mounted on a lower portion of the developer carrier 21 at a certain distance from the image carrier 10.

In FIG. 1, among the reference numbers, 25 indicates a cleaning blade for cleaning the image carrier 10 after the toner image formed on the image carrier 10 is transferred to the printing medium P, 22' indicates a waste developer removed by the cleaning blade 25, 26 indicates an agitator for agitating the developer 22 contained in the developing apparatus 20, and 27 indicates a housing constituting an outer wall of the developing apparatus 20.

The charging means 11 applies a voltage to the image carrier 10, thereby maintaining its surface potential at a constant value within a range between about −600V and about −700V. The charging means 11 comprises a conductive rubber roller, which is brought into contact with the image carrier 10. The exposure apparatus (not shown) may include a laser scanning unit (LSU), a light emitting diode (LED), or so forth. The exposure apparatus converts a digital signal, which is input from a computer or a scanner to the image forming equipment, into an optical signal. The optical signal forms the electrostatic latent image of a predetermined shape on the image carrier 10. The transferring unit 30 comprises a conductive sponge roller, which is brought into contact with the image carrier 10. Further, a high voltage is applied to the transferring unit 30 in order to transfer the toner image formed on the image carrier 10 to the printing medium P.

The developer carrier 21 is installed so that an interval from the image carrier 10 within a developing region A has a constant value within a range between about 150 μm and about 300 μm. To accomplish this, the developer carrier 21 is provided with spacing members (not shown) having a disk shape on both ends. As the developer carrier 21, a conductive rubber roller, or a roller plated with nickel (Ni) after sand blasting an aluminum cylinder may be used.

The developer layer regulating member 24 is made by folding a thin stainless steel sheet having a resilient force (a thickness from about 0.06 to about 1.0 mm) in an L shape. The developer layer regulating member 24 is mounted to the housing 27 of the developing apparatus 20, which is formed from a steel plate, by laser welding. When the developer layer regulating member 24 is mounted, the thin stainless steel sheet is subjected to deformation by the developer carrier 21, so that a resilient force having a constant line force is exerted on the developer carrier 21. The developer 22 may comprise a single component nonmagnetic developer using polyester resin as the binder resin.

The developer carrier 21, the supplying roller 23 and the developer layer regulating member 24 are supplied with a voltage from a power supply (not shown). The voltage from the power supply is one overlapping an AC voltage of a rectangular waveform with a DC voltage. The power supply is adapted to be variably controlled according to environments and conditions used.

The rotational member 40 is provided in the developing apparatus 20 to be rotatable on the lower portion of the developer carrier 21. The rotational member 40 is spaced apart from the image carrier 10 at a constant interval. The rotational member 40 rotates to generate an air stream in the direction opposite to the air stream generated by rotation of the image carrier 10. The rotational member 40 is shown in FIG. 2.

Figure 2:
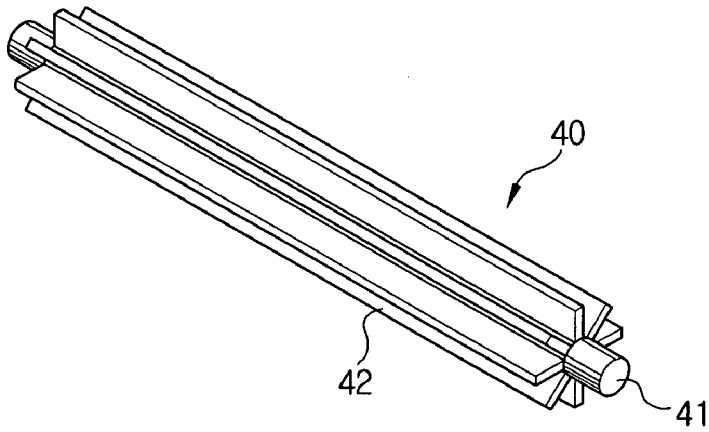
FIG. 2 is a perspective view illustrating an example of the rotational member shown in FIG. 1.

Referring to FIG. 2, the rotational member 40 includes a rotational shaft 41, both ends of which are mounted to the housing 27 of the developing apparatus 20, and at least one rotational blade 42 provided around the rotational shaft 41. The rotational blade 42 may be changed in shape or number according to conditions used.

The rotational member 40 rotates in the same direction as the rotational direction of the image carrier 10, namely, in an opposite direction to the rotational direction of the developer carrier 21, as shown in FIG. 1, in order to generate the air stream in the opposite direction to the air stream generated by rotation of both the image carrier 10 and the developer carrier 21 within the developing region A. Here, a rotation linear velocity of the rotational blade 42 is preferably equal to or greater than that of the image carrier 10. Further, a rotation driving force of the rotational member 40 is transmitted through a coupling gear from a driving gear assembled on one end of the developer carrier 21. However, the rotation driving force of the rotational member 40 may be transmitted by an independent driving means or other various ways.

Figure 3:
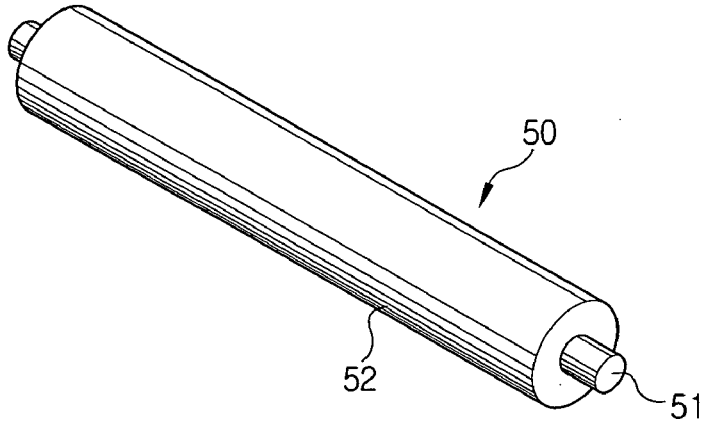
FIG. 3 is a perspective view illustrating an embodiment of the rotational member shown in FIG. 1.

FIG. 3 illustrates another rotational member 50 applicable to the developing apparatus 20 according to the first embodiment of the present invention. Referring to FIG. 3, the rotational member 50 includes a rotational shaft 51, both ends of which are mounted to the housing 27 of the developing apparatus 20, and a rotational roller 52 which takes a drum shape and is provided around the rotational shaft 51. As set forth above, the rotational member 50 rotates in the same direction as the rotational direction of the image carrier 10, that is, in the opposite direction to the rotational direction of the developer carrier 21. Here, a rotation linear velocity of the rotational roller 52 is preferably equal to or greater than that of the image carrier 10.

Meanwhile, the foregoing rotational members 40 and 50 are merely illustrative. Various types of rotational members may be applied as long as they rotate to generate the air stream in the opposite direction to the air stream generated by rotation of both the image carrier 10 and the developer carrier 21 within the developing region A.

An operation of the image forming equipment configured as set forth above will be described with reference to FIG. 1.

First, the surface of the image carrier 10 is electrically and uniformly charged by discharge of the charging means 11. Subsequently, the digital signal input from the computer or scanner into the image forming equipment is converted into the optical signal by the exposure apparatus. This optical signal forms the electrostatic latent image having a predetermined shape on the image carrier 10.

Meanwhile, the developer carrier 21 rotates in the direction in engagement with the image carrier 10 while keeping a constant interval from the image carrier 10, as shown in FIG. 1. Here, the developer carrier 21 rotates at a speed between 1.1 and 1.6 times as fast as the rotation linear velocity of the image carrier 10 so as for the developer 22 to sufficiently move to the image carrier 10.

The developer 22 contained in the developing apparatus 20 is supplied to the developer carrier 21 by the supplying roller 23. While passing through the developer layer regulating member 24, the developer 22 supplied to the developer carrier 21 has a proper charge quantity by means of frictional electrification and is simultaneously regulated to a constant thickness.

The developer 22 on the developer carrier 21 regulated in this manner is transferred to the developing region A between the image carrier 10 and the developer carrier 21. Then, when a predetermined voltage is applied from the power supply (not shown) to the developer carrier 21, the developer 22 is attached to an electrostatic latent image region formed on the image carrier 10 while reciprocating the developing region A. Thereby, a visual toner image is formed on the image carrier 10.

When the printing medium P fed from a paper feeder (not shown) enters the transferring unit 30, the toner image formed on the image carrier 10 is transferred to the printing medium P by the voltage applied to the transferring unit 30. Subsequently, the toner image transferred to the printing medium P is fixed to the printing medium P by heat and pressure of the fixing unit.

Meanwhile, while developing operation is performed, the air stream is generated downward within the developing region A by rotation of both the image carrier 10 and the developer carrier 21. Conventionally, such an air stream causes particles of the developer 22 having a low charge to be scattered out of the developing region A riding the air stream. In addition, while the printing medium P fed from the paper feeder (not shown) enters the transferring unit 30, another air stream entering along the surface of the printing medium P meets with the foregoing air stream, and thus the developer particles are scattered to an interior of the image forming equipment. As a result, the scattered developer 22 contaminates the interior of the image forming equipment.

In order to solve this drawback, in an embodiment of the present invention, the rotational member 40 provided on the lower portion of the developer carrier 21 is rotated in order to generate an offset air stream for offsetting the air stream running downward due to rotation of both the image carrier 10 and the developer carrier 21 within the developing region A. At this time, the rotational member 40 rotates in a rotational direction equal to that of the image carrier 10, i.e., opposite to that of the developer carrier 21.

When the rotational member 40 rotates in this manner, the air stream is generated between the image carrier 10 and the rotational member 40 in the arrow direction shown in FIG. 3, i.e. in an upward direction by the rotational blades 42. Thereby, the air stream generated by rotation of both the image carrier 10 and the developer carrier 21 and the air stream generated by rotation of the rotational member 40 offset each other. As a result, even the insufficiently charged particles of the developer 22 are attached again to the developer carrier 21 to circulate in the interior of the developing apparatus 20 without being scattered into the interior of the image forming equipment. Meanwhile, a quantity of the air stream generated by rotation of the rotational member 40 can be controlled by adjustment of geometrical profile, number, rotation speed, etc. of the rotational blades 42.

Figure 4:
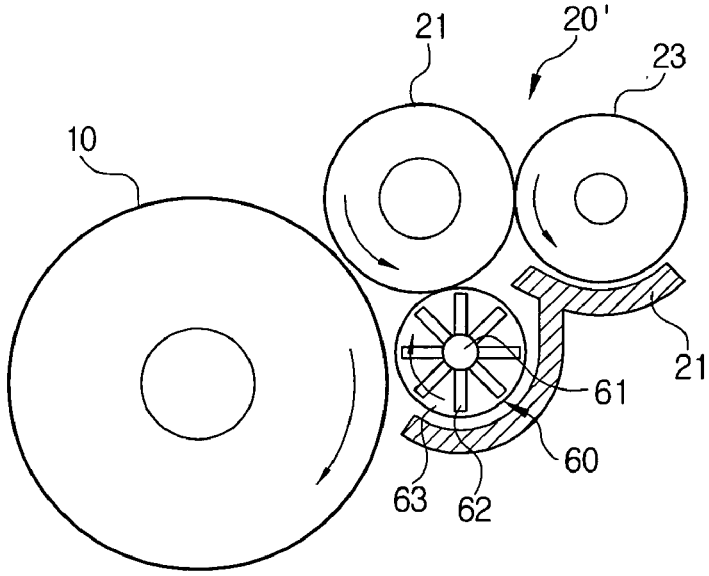
FIG. 4 schematically illustrates a main part of an image forming equipment according to a second embodiment of the present invention.
Figure 5:
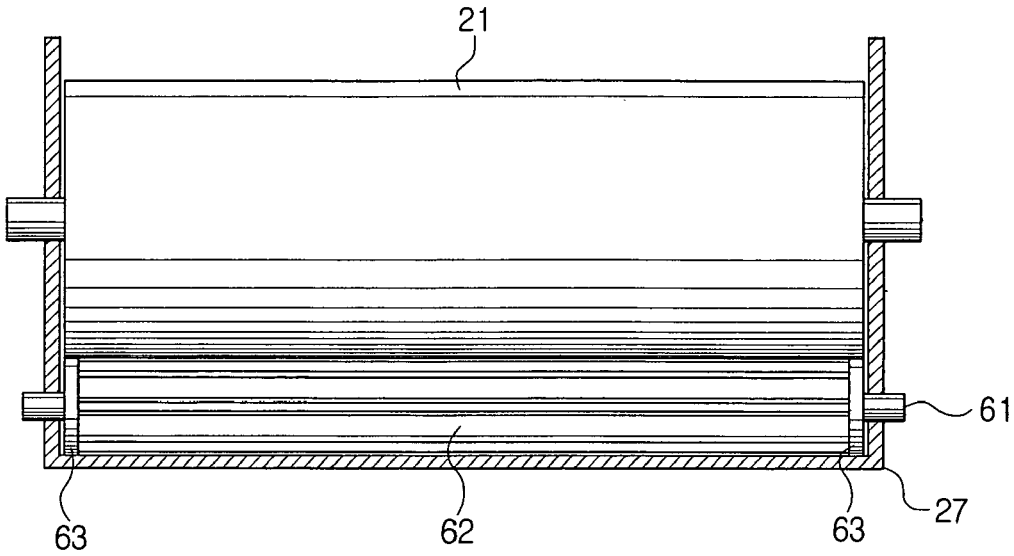
FIG. 5 is a front view of the developer carrier and the rotational member shown in FIG. 4.

FIG. 4 schematically shows a main part of an image forming equipment according to a second embodiment of the present invention. FIG. 5 is a front view of the developer carrier and the rotational member shown in FIG. 4, and FIG. 6 is a perspective view of the rotational member shown in FIG. 4.

Figure 6:
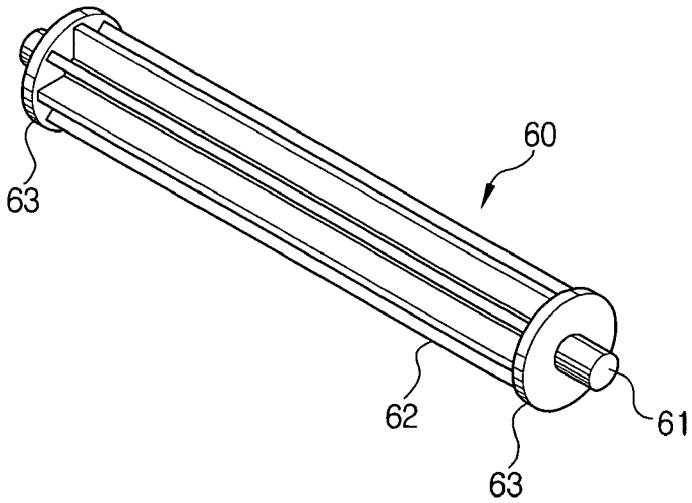
FIG. 6 is a perspective view of the rotational member shown in FIG. 4.

Referring to FIGS. 4 to 6, a developing apparatus 20' according to the second embodiment includes a rotational member 60 mounted on the lower portion of the developer carrier 21 and spaced apart from the image carrier 10 at a constant interval.

As shown in FIG. 6, the rotational member 60 includes a rotational shaft 61, both ends of which are mounted to the housing 27 of the developing apparatus 20', at least one rotational blade 62 provided around the rotational shaft 61, and a pair of rotational plates 63 provided on both ends of the rotational shaft 61. Here, the rotational blades 62 may be varied in shape or number according to conditions used.

The pair of rotational plates 63 serve as means for transmitting a driving force from the developer carrier 21, and are configured so that their outer circumferential surfaces each rotate in engagement with an outer circumferential surface of the rotating developer carrier 21, as shown in FIGS. 4 and 5. Therefore, when the developer carrier 21 rotates, the rotational plates 63 rotate in a rotational direction opposite to that of the developer carrier 21, and thereby the rotational blades 62 provided between the rotational plates 63 rotate. In this manner, the air stream is generated in an opposite direction to that generated by rotation of the developer carrier 21, so that it is possible to prevent the developer 22 from being scattered to the interior of the image forming equipment.

Figure 7:
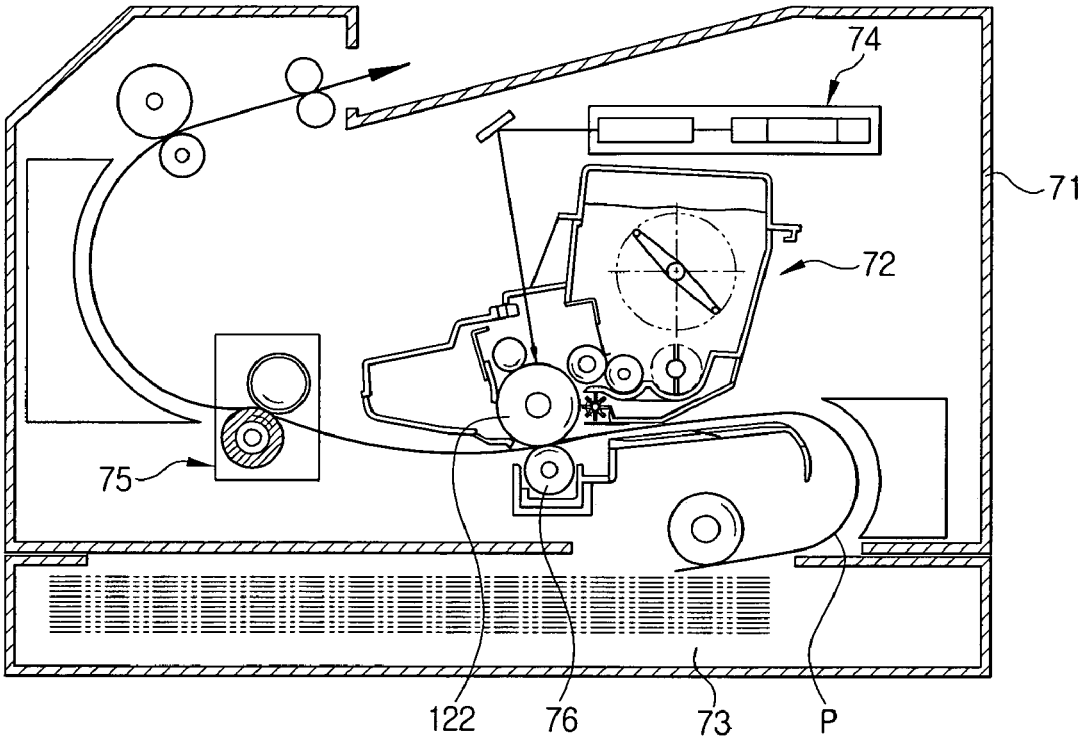
FIG. 7 illustrates a schematic configuration of an image forming equipment according to a third embodiment of the present invention.

FIG. 7 illustrates an image forming equipment according to a third embodiment of the present invention.

Referring to FIG. 7, the image forming equipment according to the third embodiment of the present invention comprises a developing apparatus 72 provided in a main body 71 of the image forming equipment, a paper feeder 73 for feeding the printing medium P to the developing apparatus 72, a laser scanning unit 74, a fixing unit 75, and a transferring unit 76.

Here, the laser scanning unit 74 scans light to form an electrostatic latent image corresponding to a desired image onto an image carrier 122 provided to the developing apparatus 72.

The laser scanning unit 74 affixes images onto the printing medium P passing through the developing apparatus 72 under high temperature and pressure, and affixes an image transferred to the printing medium P. Since the laser scanning unit 74 and the fixing unit 75 are conventional, their detailed description will be omitted.

Figure 8:
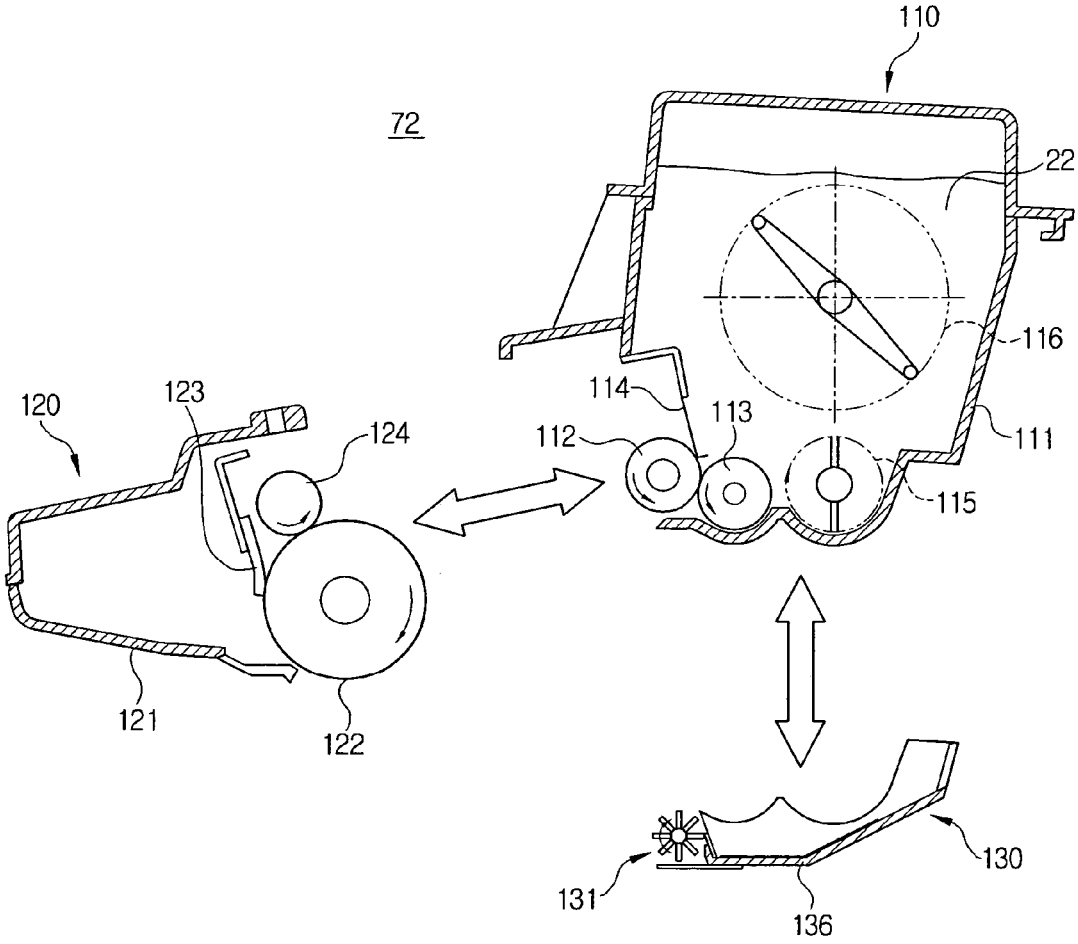
FIG. 8 is a cross-sectional view illustrating a separated state of the developing apparatus shown in FIG. 7.

The developing apparatus 72 includes first, second and third developing units 110, 120 and 130 as shown in FIG. 8.

The first developing unit 110 comprises a first housing 111, and a developer carrier 112 mounted in the first housing 111. The developer or toner 22, which is not old but new, is contained in the first housing 111. The developer carrier 112 supplies the developer to the image carrier 122 to be described below while rotating in the first housing 111. Similarly to the foregoing embodiments, in the third embodiment, that the developer is a single component nonmagnetic developer using polyester resin as binder resin will be described as an example.

The developer carrier 112 is preferably comprises a conductive rubber roller or a cylindrical metal roller comprising aluminum. It is preferable to form the metal roller by plating with nickel (Ni) after sand blasting its surface.

Further, the first housing 111 is further provided with a supplying roller 113 for supplying the developer to the developer carrier 112, and a developer layer regulating member 114 for regulating a layer of the developer on the developer carrier 112 to a constant thickness. The developer layer regulating member 114 is formed by folding a thin stainless steel sheet having a resilient force in a "L" shape, and fixed in the first housing 111 to be brought into contact with the developer carrier 112. The supplying roller 113 supplies the developer between the developer carrier 112 and the developer layer regulating member 114 while rotating in the same direction as the developer carrier 112.

The developer carrier 112, the supplying roller 113 and the developer layer regulating member 114 configured as mentioned above are supplied with AC and DC voltages in an overlapped manner from a power supply not shown. Properties of the voltages supplied from the power supply, for example peak to peak voltage (Vpp), frequency, duty ratio etc., may be properly controlled according to environments used, various printing conditions and so on.

Further, the first housing 111 is rotatably provided therein with agitators 115 and 116 for agitating the developer.

Figure 9:
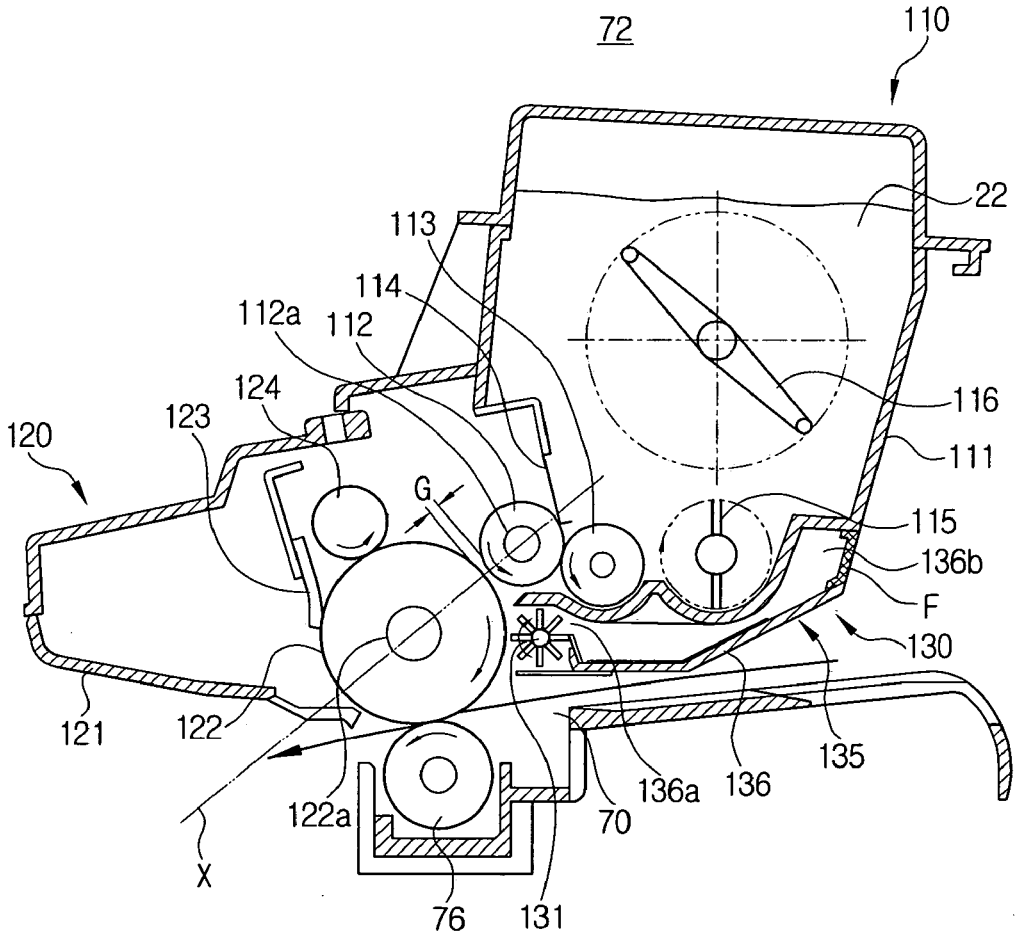
FIG. 9 is an assembled cross-sectional view of the developing apparatus shown in FIG. 8.

The second developing unit 120 includes a second unit 121, the image carrier 122, a cleaning member 123 and a charging means 124. As shown in FIG. 9, the second housing 121 is coupled with the first housing 111 so that the image carrier 122 is opposite to the developer carrier 112 at a predetermined developing gap G. The second housing 121 is provided with a containing space where a waste developer remaining after being used for developing is contained. The image carrier 122 is rotatable and supported by the second housing 121 to be partially exposed outside. The image carrier 122 is opposite to the developer carrier 112 and rotates in a forward direction together with the developer carrier 112. The image carrier 122 is driven at a rotation linear velocity smaller than that of the image carrier 122.

The cleaning member 123 comes into contact with the image carrier 122 to remove the waste developer remaining at the image carrier 122. As one example of the cleaning member 123, a cleaning blade having a resilient force may be employed. The charging means 124 electrifies the surface of the image carrier 122 to a predetermined potential, and employs a conductive rubber roller rotating in the forward direction in contact with the image carrier 122 in the present embodiment.

Here, the image carrier 122 is coupled with a predetermined driver when the developing apparatus 72 is mounted in the main body 10 of the image forming equipment, thereby being supplied with a driving force from the predetermined driver. The driving force supplied to the image carrier 122 may be transmitted to members 112, 113, 115 and 116 in the first housing 111. Alternatively, the members 112, 113, 115 and 116 may be supplied with the driving force from a separate driver. The driver of the developing apparatus 20 will be described below.

Further, the transferring unit 76 includes a transferring roller rotating in contact with the image carrier 122. A predetermined voltage is applied to the transferring unit 76. Thus, the image formed on the image carrier 122 is transferred to the printing medium passing between the image carrier 122 and the transferring unit 76 by a potential difference between the image carrier 122 and the transferring unit 76. A feed passage 70 is provided at a lower side of the developing apparatus 72 and the printing medium onto which the image is transferred passes through the passage 70.

Figure 10:
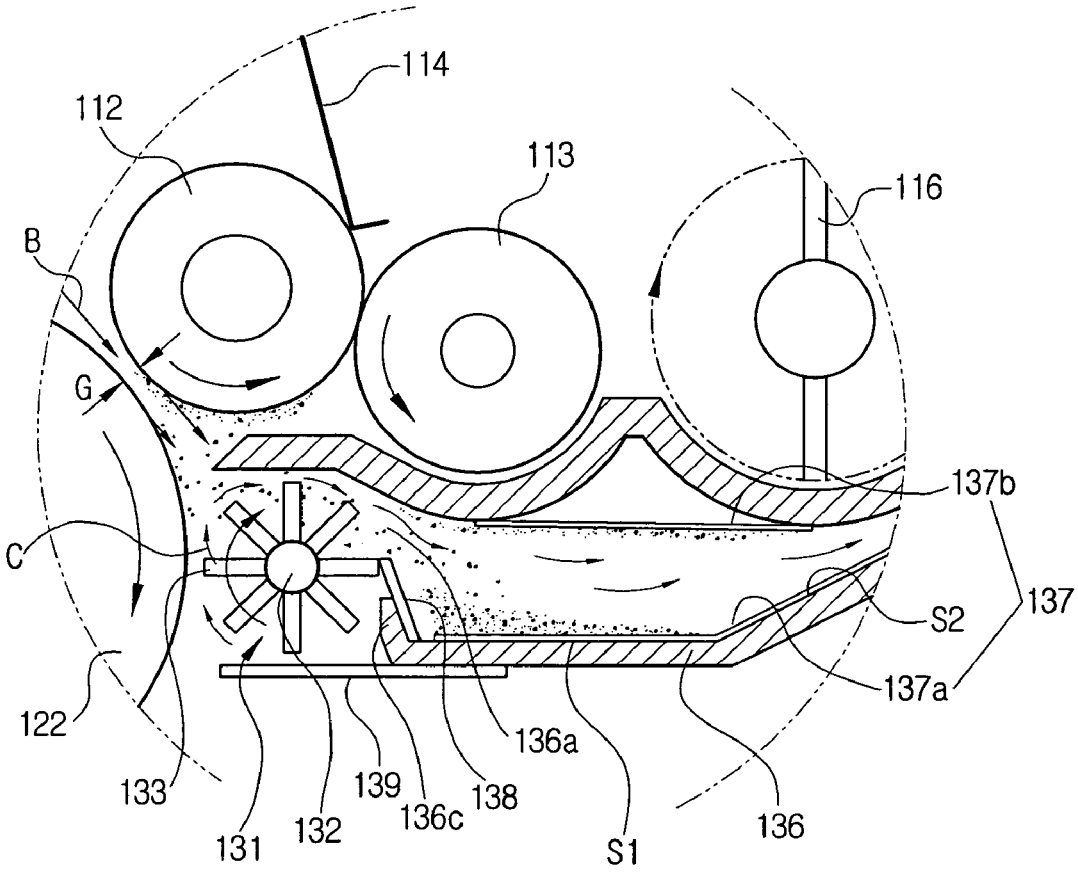
FIG. 10 is an enlarged cross-sectional view of a main part of FIG. 9.

The third developing unit 130 is used to inhibit the developer from being scattered between the image carrier 122 and the developer carrier 112. In other words, both the image carrier 122 and the developer carrier 112 rotate in the forward direction at a predetermined speed, and thereby the air stream is generated at the developing gap G in a direction of an arrow B, as shown in FIG. 10. The air stream directing in the direction of the arrow B deteriorates a charged property and scatters the disturbed fine particles of the developer in a downstream direction, which can be inhibited by the third developing unit 130.

Referring to FIGS. 8, 9 and 10, the third developing unit 130 includes a rotational member 131 for generating the air stream in a direction of an arrow C opposite to the direction of the arrow B, and a scattered developer container 135 for collecting the developer (hereinafter, referred to as "scattered toner") guided by the air stream generated by the rotational member 131.

The rotational member 131 is rotatably mounted opposite to the developing gap G on a lower side of the first housing 111. Further, the rotational member 131 is spaced apart from the image carrier 122 at a predetermined distance and rotates in the opposite direction to the image carrier 122. As shown in FIG. 9, it is preferable that the rotational member 131 is provided under a line X connecting a shaft 122A of the image carrier 122 and a shaft 112A of the developer carrier 112. As the rotational member 131 rotates, the air stream is generated in the direction of the arrow C. Thus, the toner scattered in the direction of the arrow B is shifted either toward the developing gap G again or toward the scattered developer container 135, thus being collected into the scattered developer container 135. The rotational member 131 includes a rotational shaft 132 which is rotatably installed in the scattered developer container 135, and at least two rotational blades 133. The rotational blades 133 are radially formed on an outer circumference of the rotational shaft 132. It is preferable that the rotational blades 133 and the rotational shaft 132 are integrally formed of a plastic material. The rotational member 131 is preferably supplied with the driving force from either the image carrier 122 or the developer carrier 112, thereby being rotatably driven. This method of supplying the driving force will be described below.

Referring to FIG. 10, the scattered developer container 135 includes a third housing 136 coupled on the lower side of the first housing 111, a developer scattering inhibitor 137, and first and second plate members 138 and 139.

The third housing 136 is preferably formed integrally with the first housing 111. The third housing 136 is provided with an inlet 136A into which the toner is introduced together with air, and an outlet 136B (see FIG. 9) through which the introduced air is exhausted. The inlet 136A and the outlet 136B are opposite to each other. The outlet 136B is provided at a higher position than the inlet 136A, and thereby the introduced toner can be inhibited from being scattered through the outlet 136B. Further, the inlet 136A is provided at a higher position than an inner bottom surface S1 of the third housing 136. To this end, the inlet 136A is provided with a step 136C.

The developer scattering inhibitor 137 is for inhibiting the toner introduced into the third housing 136 through the inlet 136A from being discharged toward the outlet 136B again. The developer scattering inhibitor 137 includes first and second adhesive layers 137A and 137B provided in the third housing 136, and a slant surface s2 extending from the bottom surface S1 of the third housing 136.

The first adhesive layer 137A is provided on the bottom surface of the third housing 136, while the second adhesive layer 137B is provided a ceiling of the third housing 136, i.e. on the lower side of the first housing 111. These adhesive layers 137A and 137B may be provided by attaching a phlegmatic member, for example a double sided tape, on the surface of the third housing 136. The toner is attached to the adhesive layers 137A and 137B, and thus inhibited from being scattered.

Further, the slant surface s2 is formed at an angle inclined upward from the bottom surface S1 to the outlet 136B. This slant surface s2 can prevent the toner introduced into the third housing 136 from flowing or being pushed toward the outlet 136B.

The scattered developer container 135 includes first and second plate members 138 and 139, which are supported on the third housing 136. The first plate member 138 is installed at the inlet 136A of the third housing 136 and disposed to be so near as to come into contact with the rotational blades 133 of the rotational member 131. The first plate member 138 is provided so as to be capable of guiding the toner guided by the rotational blades 133 toward the inlet 136A to the maximum extent, and is preferably a film formed of polyethylene terephthalate (PET) or urethane to be resiliently deformed. Thus, even when the rotational blade 133 is brought into contact with the first plate member 138, the rotational member 131 performs a rotational operation without breakdown of the two members 133 and 138 due to the resilient deformation of the first plate member 138.

Further, the second plate member 139 is supported on the lower side of the third housing 136, and extends to the lower side of the rotational member 131. The second plate member 139, also, is formed of a material similar to the first plate member 138, and is preferably formed from a resiliently deformable film. Thus, the second plate member 139 is provided as adjacent as possible to the rotational blades 133, thereby preventing the toner from falling down to the lower side of the rotational member 131. The toner falling down to the second plate member 139 is turned again in the direction of the arrow C by the air stream generated by the rotational blades 133, so that it is possible to collect the toner into the third housing 136.

Also, as shown in FIG. 9, it is preferable that the outlet 136B is further provided with a filter F. In this case, when a relatively large quantity of scattered toner is collected into the third housing 136, a little quantity of scattered toner may be discharged again through the outlet 136B and scattered. The discharged scatted toner can be filtered by the filter F. The filter F is formed of a porous material such as a sponge, and can be easily installed at the outlet 136B by means of an adhesive such as a bond.

Figure 11:
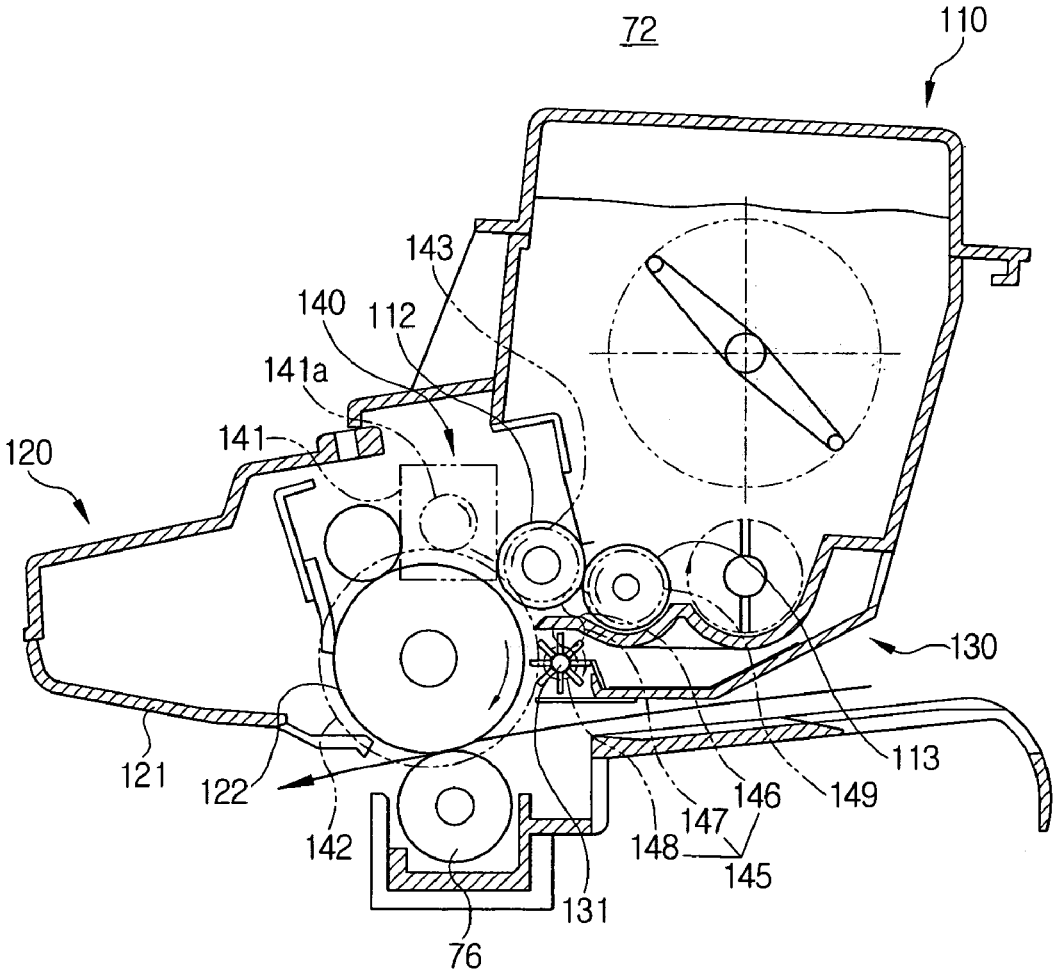
FIG. 11 is a cross-sectional configuration view illustrating a power transmission mechanism of the developing apparatus shown in FIG. 9.

Referring to FIG. 11, there is provided a driver 140 for driving the rotational member 131. The driver 140 includes a driving motor 141 for driving the developing apparatus 20, and a transmission unit 145 for transmitting the driving force of the developing apparatus 72 to the rotational member 131.

The driving motor 141 is provided in the main body 10. When the developing apparatus 20 is mounted in the main body 10, the driving motor 141 is preferably disposed to be coupled to a driving gear 142 of the image carrier 122. In other words, a shaft gear 141A of the driving motor 141 is geared to the driving gear 142, thus transmitting the driving force. The driving gear 142 is coupled to a gear 143 of the developer carrier 112, thus transmitting the driving force.

The transmission unit 145 comprises first and second idle gears 146 and 147 which are sequentially coupled from the gear 143 of the developer carrier 112, and a driven gear 148. The driven gear 148 is coupled to one end of the rotational shaft 132 of the rotational member 131. The first and second idle gears 146 and 147 are coupled to the developing apparatus 72, and transmit the driving force of the gear 143 to the driven gear 148. A gear 149 of the supplying roller 113 is coupled to the first idle gear 146 and driven.

Meanwhile, unlike the foregoing embodiments, the transmission unit may be applied to directly transmit the driving force of the image carrier 122 to the rotational member 131. Further, it should be apparent that the rotational member 131 may be driven using a separate motor unlike the driving motor 141 of the developing apparatus 72.

Figure 12:
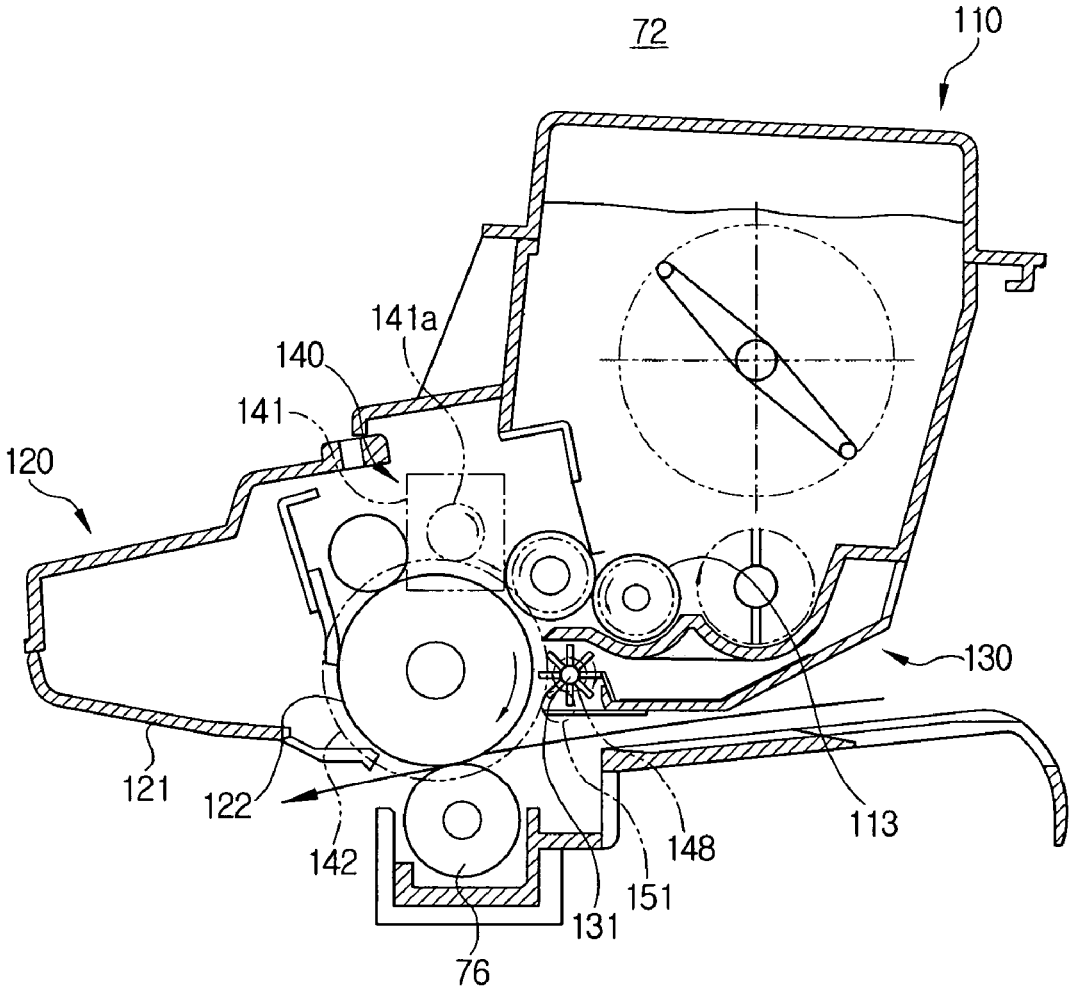
FIG. 12 is a cross-sectional configuration view illustrating another example of the power transmission mechanism of the developing apparatus shown in FIG. 11.

In addition, as shown in FIG. 12, the driving force of the image carrier 122 may be directly transmitted to the driven gear 149 of the rotational member 131 using an idle gear 151.

Hereinafter, an operation of the image forming equipment, which has the foregoing configuration, according to the third embodiment of the present invention will be described.

Referring to FIG. 7, during printing operation, the paper feeder 73 picks up the printing medium P, and the printing medium P is fed toward the developing apparatus 72. On the basis of input printing data, the laser scanning unit 74 scans light to the image carrier 122 to form a predetermined electrostatic latent image.

As shown in FIGS. 8 and 11, the developer carrier 112, which rotates together with the image carrier 122, transfers a developer to the electrostatic latent image region while rotating in the forward direction with respect to the rotational direction of the image carrier 122. Here, the developer carrier 112, the supplying roller 113 and the developer layer regulating member 114 are supplied with AC and DC voltages in the overlapped manner. Therefore, at the developing gap G between the image carrier 122 and the developer carrier 112, the developer is shifted to the electrostatic latent image region of the image carrier 122 by a potential difference between a potential of the electrostatic latent image region and an electrostatic force generated from the developer carrier 112.

Meanwhile, an air stream is generated in the direction of the arrow B at the developing gap G. Some particles of the developer are disturbed by the air stream generated in this manner. Thus, the developer particles which are subjected to disturbance, weakening of charged property, etc. are shifted down the developing gap G by the air stream flowing in the direction of the arrow B.

The developer particles shifted down the developing gap G, i.e. toner particles, are shifted again to the developing gap G by another air stream which is generated in the direction of the arrow C by the rotational member 131, as shown in FIG. 10. Some toner particles scattered are collected into the third housing 136 by the rotational member 131. The collected toner particles are attached to the adhesive layers 137A and 137B, thereby being inhibited from escaping. Further, the collected toner particles are inhibited from moving to the outlet 136B by the slant surface s2. Meanwhile, air introduced into the inlet 136A together with the toner particles is discharged through the outlet 136B with the toner particles left behind in the third housing 136.

Further, the toner particles of small quantity are prevented from being scattered outside the developing apparatus 72 by the first and second plate members 138 and 139 and recollected by the rotational member 131. Actually, the scattered toner particles collected into the third housing 136 is very small in quantity. For this reason, the third housing 136 has a space capable of collecting the toner particles until the developing apparatus 72 is replaced by a new one. Thus, a collection of the scattered toner particles is eliminated when the developing apparatus 72 is replaced by a new one.

As set forth above, the image forming equipment according to the third embodiment of the present invention generates the air stream in the reverse direction to the air stream generated at the developing gap, thus being capable of inhibiting the developer from being scattered.

Further, the scattered partial developer particles are collected and stored into an additional collection space, so that it is possible to prevent the interior of the image forming equipment from being contaminated by scattering of the developer.

Also, the scattered toner is prevented from being attached to a non-image region of the image carrier, so that it is possible to improve a quality of the printed image.

In addition, the members for inhibiting the developer from being scattered are driven using the driving force of the developing apparatus without a separate driving force, so that it is possible to provide the image forming equipment compact and inexpensively by simplifying its structure and maintaining additional costs at a minimum.

Furthermore, the collected scattered developer is stored in the developing apparatus, so that it is capable of being displaced and discarded together when the developing apparatus reaches its service life to be displaced by a new one. Thus, it is convenient for a user to manage the developer.

Figure 13:
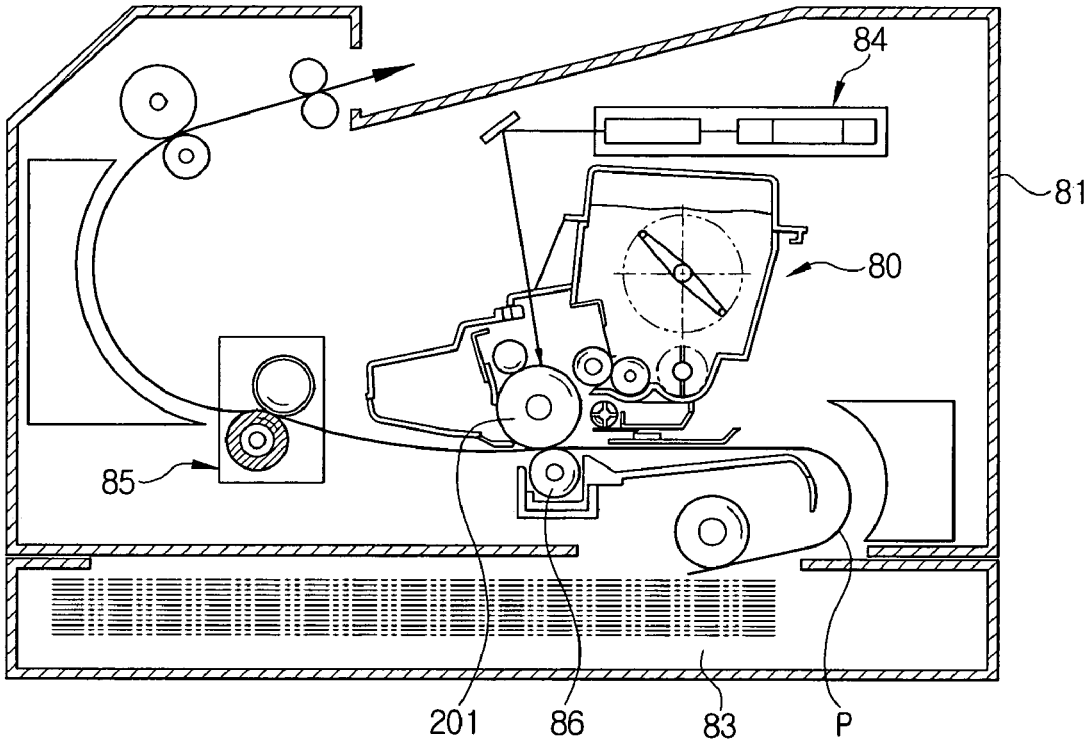
FIG. 13 is a schematic cross-sectional view illustrating a configuration of an image forming equipment according to a fourth embodiment of the present invention.

FIG. 13 shows a schematic configuration of an image forming equipment according to a fourth embodiment of the present invention.

Referring to FIG. 13, the image forming equipment comprises a developing apparatus 80 provided in a main body 81 thereof, a paper feeder 83 for feeding the printing medium P to the developing apparatus 80, a laser scanning unit 84, a fixing unit 85, and a transferring unit 86.

Here, since the paper feeder 83, the laser scanning unit 84, the fixing unit 85 and the transferring unit 86 has the same configuration and operation as the components described above with reference to FIG. 7, a detailed description will be omitted.

Figure 14:
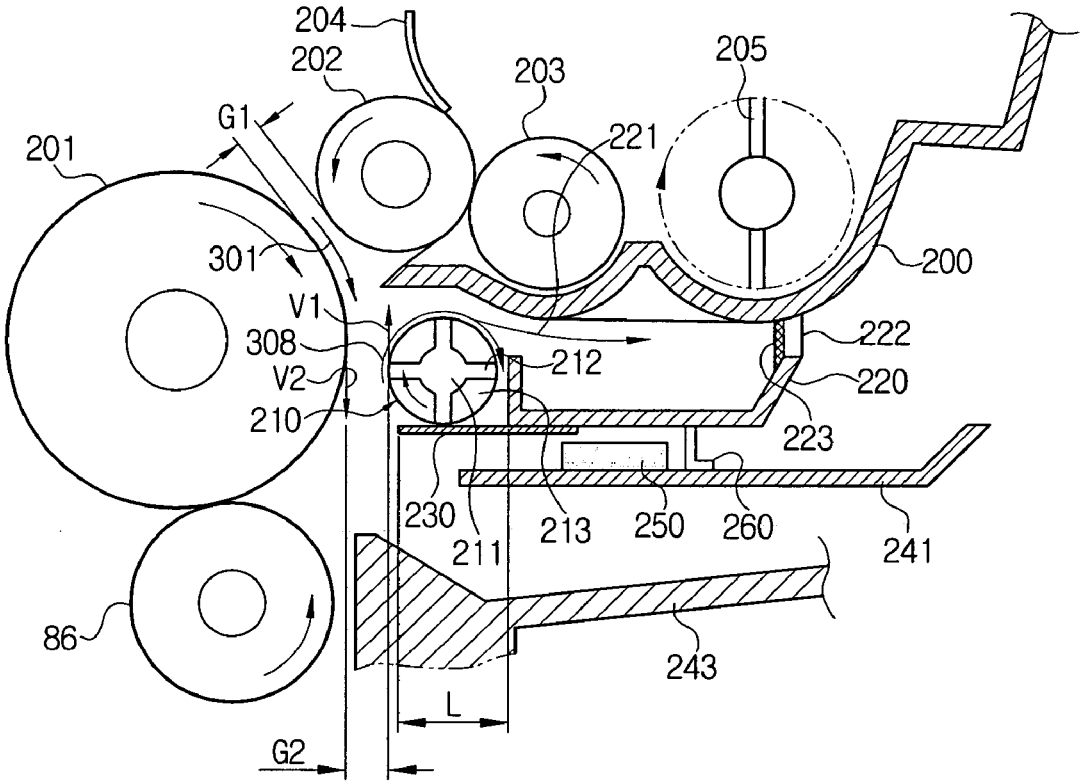
FIG. 14 is a partial magnified view illustrating the developing apparatus shown in FIG. 13.

As shown in FIG. 14, the developing apparatus 80 includes a housing 200, an image carrier 201 mounted in the housing 200 to be rotatable in one direction, a developer carrier 202, a rotational member 210 and a scattered developer container 220.

A new developer or toner is contained in the housing 200. The developer carrier 202 supplies the developer to the image carrier 201 while rotating in the housing 200. Here, the developer is a single component non-magnetic developer using polyester resin as binder resin, which will be described by way of an example.

Preferably, the developer carrier 202 is a conductive rubber roller or a cylindrical metal roller of aluminum. The metal roller is preferably formed by being plated with nickel (Ni) after its surface is subjected to sand blasting.

Further, the housing 200 is further provided with a supplying roller 203 for supplying the developer to the developer carrier 202, and a developer layer regulating member 204 for regulating a developer layer on a surface of the developer carrier 202 to a constant thickness. The supplying roller 203 supplies the developer between the developer carrier 202 and the developer layer regulating member 204 while rotating in the same direction as the developer carrier 202.

The developer carrier 202, the supplying roller 203 and the developer layer regulating member 204 configured as mentioned above are both supplied with AC and DC voltages from a power supply not shown. Properties of the voltages applied from the power supply, for example Vpp (peak to peak voltage), frequency, duty ratio etc., may be properly controlled according to environments used, various printing conditions and so on.

Further, the housing 200 is rotatably provided therein with agitator 205 for agitating the developer.

The image carrier 201 is disposed opposite to the developer carrier 202 and rotates in a forward direction together with the developer carrier 202. The image carrier 201 is driven at a rotation linear velocity slower than that of the image carrier 202. Between the image carrier 201 and the developer carrier 202 is formed a predetermined developing gap G1. Thus, the developer of the surface of the developer carrier 202 is shifted to the electrostatic latent image region of the image carrier 201 by a so-called jumping developing method. The developing gap G1 is kept within a range between about 0.3 mm and about 0.4 mm.

The rotational member 210 is to inhibit scattering of the developer which is caused by an air stream generated at the developing gap G1 by rotation of the image carrier 201 and the developer carrier 202. In other words, during the printing operation, both the image carrier 201 and the developer carrier 202 rotate in the forward direction at a predetermined speed, and thereby the air stream 301 of the image carrier 201 is generated at the developing gap G1. In order to inhibit the scattering of fine particles of the developer which are weakened in charge and are subjected to disturbance by the air stream 301, the rotational member 210 generates another air stream 308 opposite to the air stream 301.

The rotational member 210 is composed of a shaft 211, and a plurality of rotational blades 212 radially formed on an outer circumference of the shaft 211. Both the shaft 211 and the rotational blades 212 may be integrally formed of a plastic material. Further, the rotational member 210 has a rotational plate 213 for receiving a driving force on at least one end thereof. The rotational plate 213 is rotatably driven by the driving force directly/indirectly transmitted from the image carrier 201 or the developer carrier 202 through a coupling gear, etc.

This rotational member 210 is rotatably installed opposite to the image carrier 201 on a lower side of the housing 200. It is good that the rotational member 210 is installed to have a predetermined interval, preferably a gap G2 within about 3 mm, from the image carrier 201. Thus, it is possible to minimize the escape of the scattered developer between the image carrier 201 and the rotational member 210.

Further, it is preferable that the rotational member 210 is rotated so that a linear velocity V1 at the extreme outside thereof the rotational member 210 has a value between about 50% and about 150% compared with a linear velocity V2 at an outer circumference of the image carrier 201. Specifically, when the printing speed amounts to about 20 pages per minute (PPM), the linear velocity V2 of the image carrier 201 is slower than the linear velocity V1. In this case, since the air stream is not generated in large quantity, it is possible to inhibit scattering of the developer even when the linear velocity V1 of the image carrier 201 has a relatively low value between about 50% and about 100%. By contrast, when the printing speed is a high speed between about 30 PPM and about 40 PPM, it is possible to generate the air stream 308 in the reverse direction by increasing the linear velocity V1 of the image carrier 201 up to a value between about 100% and about 150%.

Further, the scattered developer container 220 for containing the scattered developer collected by the rotational member 210 is provided on the lower side of the housing 200. The scattered developer container 220 has an inlet 221 and an outlet 222. The rotational member 210 is mounted in the proximity of the inlet 221. The scattered developer entering the inlet 221 is introduced and deposited into the scattered developer container 220. The air flows out to the outlet 222. A filter 223 may be further installed at the outlet 222 so as not to prevent fine particles of the developer from escaping.

In addition, a plate member 230 is further provided on the lower side of the rotational member 210. The plate member 230 is formed of a film material capable of resiliently deformed and is mounted on a lower side of the scattered developer container 220. Preferably, a gap between the plate member 230 and the rotational member 210 is between 0 mm and about 3 mm. Thus, the developer, which is contained in the air stream guided and rotated together by the rotational member 210 without entering the inlet 221, has a possibility to ride on the air stream 308 again. Further, it is good to provide a length L of the plate member 230 to be longer than a radius based on the extreme outside of the rotational member 210. When the length L of the plate member 230 is sufficiently secured, it is possible to effectively control intensity and direction of the air stream 308 by rotation of the rotational member 210. The plate member 230 may be formed integrally with the scattered developer container 220. It is preferable to form the plate member 230 to bond a resilient film material to the scattered developer container 220 by means of an adhesive, etc.

Also, upper and lower guide members 241 and 243 for guiding the fed printing medium are provided on the lower side of the scattered developer container 220. The upper and lower guide members 241 and 243 are spaced apart from each other at a predetermined distance.

A pre-transfer lamp (PTL) 250 is supported on an upper portion of the upper guide member 241. The PTL 250 is for lowering a potential difference between an image region of the image carrier 201 on which the image is formed and a non-image region of the image carrier 201. When the potential difference is lowered by the PTL 250, the image of the image carrier 201 can be controlled to be transferred to the printing medium P with more ease.

In order to install the PTL 250, a predetermined space is provided between the upper guide member 241 and the scattered developer container 220. Hence, a sealing member 260 is provided so that the developer does not flow between the upper guide member 241 and the scattered developer container 220. The sealing member 260 comprises a rubber material, and may be installed to the upper guide member 241 or the scattered developer container 220. Further, the sealing member 260 is located at the rear of the PTL 250.

Hereinafter, an operation of the image forming equipment, having the foregoing configuration, according to the fourth embodiment of the present invention will be described.

First, referring to FIG. 13, during printing operation, the paper feeder 83 picks up the printing medium P, and the printing medium P is fed toward the developing apparatus 80. On the basis of input printing data, the laser scanning unit 84 scans light to the image carrier 201 to form a predetermined electrostatic latent image.

As shown in FIG. 14, the developer carrier 202, which rotates with the image carrier 201, transfers a developer to the electrostatic latent image region of the image carrier 201 while rotating in the forward direction with respect to the rotational direction of the image carrier 201. Here, the developer carrier 202, the supplying roller 203 and the developer layer regulating member 204 are both supplied with AC and DC voltages. Therefore, at the developing gap G1 between the image carrier 201 and the developer carrier 202, the developer is shifted to the electrostatic latent image region of the image carrier 201 by a potential difference between a potential of the electrostatic latent image region and an electrostatic force generated from the developer carrier 202.

Figure 15:
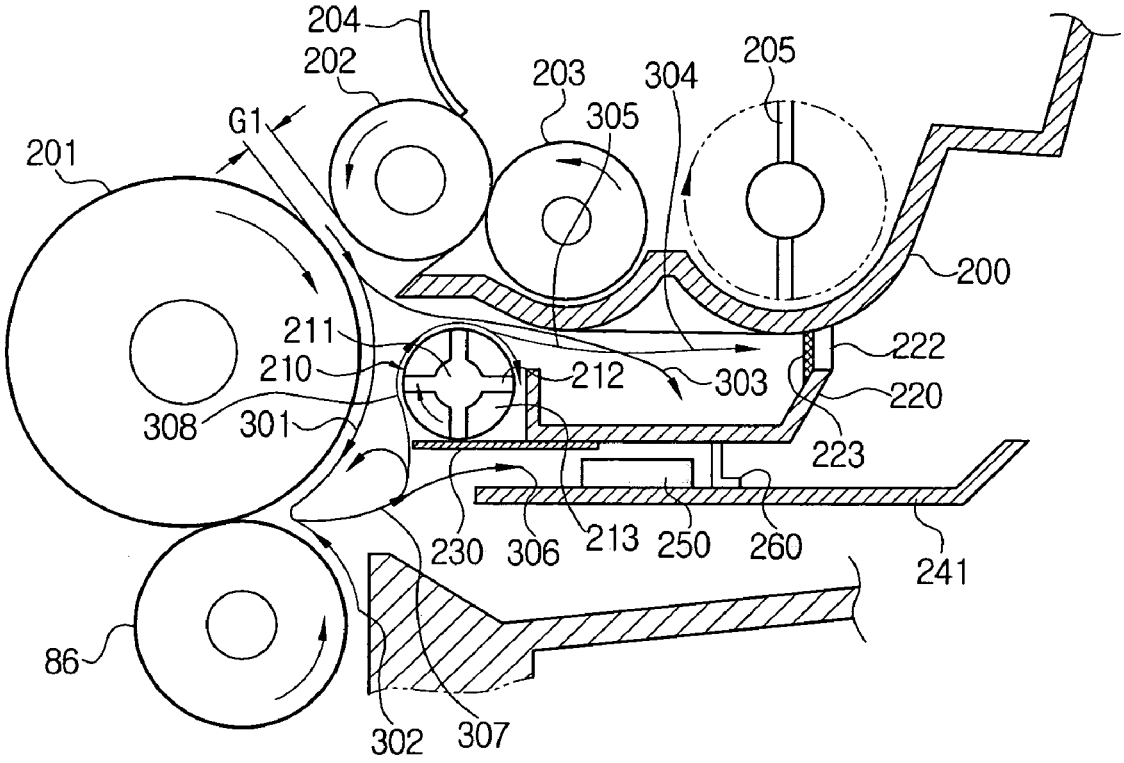
FIG. 15 is a view illustrating an air stream generated when a printing operation is performed in a state of FIG. 14.

Meanwhile, as shown in FIG. 15, an air stream 301 of the image carrier 201 is generated at the developing gap G1 by rotation of the image carrier 201 and the developer carrier 202. Some particles of the developer are disturbed by the air stream 301. Thus, the developer particles which are subjected to disturbance, weakening of the charge, etc. are shifted down the developing gap G1 by the air stream 301.

Further, another air stream 302 is generated by rotation of the transferring roller 86. The air stream 302 of the transferring roller 86 and the air stream 301 of the image carrier 201 collide with each other to generate a vortex 307. A part of the vortex 307 evolves into a scattered air stream 306 containing the scattered developer. The scattered air stream 306 flows between the upper guide member 241 and the scattered developer container 220, but is blocked by the sealing member 260.

Also, another part of the vortex 307 is collected by the rotational member 210, thereby evolving into an air stream 308 of the rotational member, and the other parts of the vortex 307 are left in a vortex form as they stand.

A part of the air stream 308 of the rotational member 210 keeps on rotating while the rotational member 210 rotates. Another part of the air stream 308, namely, an actual anti-scattering air stream 305 is combined with an air stream 303 derived from the air stream 301 of the image carrier 201 and then enters the scattered developer container 220 to be mostly dispersed. In addition, the other parts of the air stream 308 disappear in the air stream 304 flowing out to the outlet 222. The scattered developer is not substantially contained in the escaping air stream 304 and, if any, is filtered and collected by the filter 223.

Meanwhile, in an embodiment of the present invention, the magnitude of the rotational linear velocity V1 of the rotational member 210 is controlled to be sufficiently great compared with the rotational linear velocity V2 of the image carrier 201, so that it is possible to minimize generation of the scattered air stream 306 and to greatly increase a quantity at which the air stream 308 of the rotational member is generated.

Further, the gap G2 between the rotational member 210 and the image carrier 201 is controlled to be narrow to the maximum extent, so that it is possible to basically minimize generation of the air stream 301 of the image carrier, and to maximize the intake effect of the anti-scattering air stream 305 by the aid of the rotational member 210. Accordingly, it is possible to elementally reduce the scattered air stream 306.

In addition, the plate member 230 is installed and the interval between the plate member 230 and the rotational member 210 is formed as small as possible, so that the air stream 308 of the rotational member and the anti-scattering air stream 305 can be controlled to be generated as great as possible.

As set forth above, for the image forming equipment according to the fourth embodiment of the present invention, the rotation member is provided to generate an air stream reverse to that generated at the developing gap. As a result, it is possible to inhibit the developer from being scattered.

Further, a part of the scattered developer is collected and stored in an additional collection space, so that it is possible to prevent the interior of the image forming equipment from being contaminated by scattering of the developer.

Also, it is possible to prevent the scattered developer from contaminating the printing medium, the laser scanning unit, the driving gear, etc., and thereby a quality of the printed image can be improved.

In addition, the collected scattered developer is stored in the interior of the developing apparatus, so that the developer can be displaced and discarded together when the developing apparatus reaches its service life to be displaced by a new one. Thus, it is convenient for a user to manage the developer.

Additional advantages, objects, and features of the embodiments of the invention will be set forth in part in the description which follows and in part will become apparent to those having ordinary skill in the art upon examination of the following, or may be learned from practice of the invention. The objects and advantages of the embodiments of the invention may be realized and attained as particularly pointed out in the appended claims.

What is claimed is:

1. A developing apparatus of image forming equipment, comprising:

a developer carrier for developing an electrostatic latent image formed on an image carrier during rotation;

a rotational member, rotatably installed adjacent to the image carrier, for generating an air stream reverse to that generated by rotation of both the image carrier and the developer carrier;

wherein the rotational member comprises a rotational shaft and at least one rotational blade provided on the rotational shaft; and a scattered developer container for containing a scattered developer shifted by the air stream generated by rotation of the rotational member.

2. The developing apparatus as claimed in claim 1, wherein the rotational member is provided on a lower portion of the developer carrier.

3. The developing apparatus as claimed in claim 1, wherein the rotational member rotates in a rotational direction equal to that of the image carrier.

4. The developing apparatus as claimed in claim 1, wherein the rotational member has a rotational linear velocity equal to or greater than that of the image carrier.

5. The developing apparatus as claimed in claim 1, wherein the rotational member includes a rotational shaft and a rotational roller provided on the rotational shaft.

6. The developing apparatus as claimed in claim 1, wherein the rotational member is installed to receive a driving force from any one of the image carrier and the developer carrier.

7. The developing apparatus as claimed in claim 1, wherein the rotational member has a linear velocity ranging from about 50% to about 150% compared with that of a surface of the image carrier.

8. The developing apparatus as claimed in claim 1, further comprising:

a first housing where the developer carrier is installed and a new developer is contained; and a second housing where the image carrier is rotatably supported and a waste developer is contained, wherein the scattered developer container is rotatably disposed on an outer side of the first housing.

9. The developing apparatus as claimed in claim 1, wherein the rotational member is spaced apart from the image carrier at an interval within about 3 mm.

10. The developing apparatus as claimed in claim 1, wherein the developer carrier is spaced apart from an image carrier at a predetermined interval.

11. The developing apparatus as claimed in claim 1, wherein the rotational member further includes at least one transmission unit to which a driving force is transmitted from the developer carrier.

12. The developing apparatus as claimed in claim 11, wherein the transmission units are provided on both ends of the rotational shaft of the rotational member respectively, and include a pair of rotational plates rotating in engagement with an outer circumferential surface of the developer carrier.

13. An image forming equipment, comprising:

an image carrier;

a developer carrier for developing an electrostatic latent image formed on the image carrier during rotation; and a rotational member, rotatably installed adjacent to the image carrier, for generating an air stream reverse to that generated by rotation of both the image carrier and the developer carrier;

a scattered developer container for containing a scattered developer shifted by the air stream generated by rotation of the rotational member;

a first housing in which the developer carrier is installed and a new developer is contained; and a second housing in which the image carrier is rotatably supported and a waste developer is contained, wherein the rotational member is rotatably installed on an outer side of the first housing.

14. The image forming equipment as claimed in claim 13, wherein the rotational member is installed on a lower portion of the developer carrier.

15. The image forming equipment as claimed in claim 13, wherein the rotational member rotates in a rotational direction equal to that of the image carrier.

16. The image forming equipment as claimed in claim 13, wherein the rotational member has a rotational linear velocity equal to or greater than that of the image carrier.

17. The image forming equipment as claimed in claim 13, wherein the rotational member includes a rotational shaft, and at least one rotational blade provided on the rotational shaft.

18. The image forming equipment as claimed in claim 13, wherein the rotational member includes a rotational shaft, and a rotational roller provided on the rotational shaft.

19. The image forming equipment as claimed in claim 13, wherein the scattered developer container includes a third housing installed on a lower side of the first housing and is provided with an inlet and an outlet.

20. The image forming equipment as claimed in claim 13, wherein the rotational member is installed downstream of a rotational direction of the image carrier and rotates in the same direction as the image carrier.

21. The image forming equipment as claimed in claim 13, wherein the developer carrier is spaced apart from an image carrier at a predetermined interval.

22. The image forming equipment as claimed in claim 13, wherein the rotational member is installed to receive a driving force from any one of the image carrier and the developer carrier.

23. The image forming equipment as claimed in claim 22, wherein the rotational member is spaced apart from the image carrier at an interval within about 3 mm.

24. The image forming equipment as claimed in claim 13, further comprising a pre-transfer lamp, installed on a lower side of the scattered developer container, for lowering a potential difference between an image region of the image carrier and an non-image region of the image carrier.

25. The image forming equipment as claimed in claim 24, wherein the pre-transfer lamp is mounted on a guide member for guiding a printing medium fed to a lower side of the image carrier.

26. The image forming equipment as claimed in claim 25, wherein a sealing member is provided between the guide member and the scattered developer container.

27. The image forming equipment as claimed in claim 13, further comprising a film member supported to the scattered developer container so as to be installed on a lower side of the rotational member.

28. The image forming equipment as claimed in claim 27, wherein the film member is spaced apart from the rotational member at an interval ranging from about 0 mm to about 3 mm.

29. The image forming equipment as claimed in claim 27, wherein the film member has a length extending from the scattered developer container, the length being greater than a radius of the rotational member.

30. A method for preventing toner from contaminating a printing apparatus, comprising:

developing an electrostatic latent image formed on an image carrier during rotation of a developer carrier and the image carrier; and generating an air stream reverse to that generated by rotation of both the image carrier and the developer carrier via a rotational member, rotatably installed adjacent to the image carrier, wherein the rotational member includes a rotational shaft and at least one rotational blade provided on the rotational shaft; and containing a scattered developer in a scattered developer container, wherein the scattered developer is shifted by the air stream generated by rotation of the rotational member.

31. The method as claimed in claim 30, further comprising:

providing the rotational member on a lower portion of the developer carrier.

32. The method as claimed in claim 30, wherein the rotational member rotates in a rotational direction equal to that of the image carrier.

33. The method as claimed in claim 30, wherein the rotational member has a rotational linear velocity equal to or greater than that of the image carrier.

34. The method as claimed in claim 30, wherein the developer carrier is spaced apart from the image carrier at a predetermined interval.

35. A developing apparatus of image forming equipment, comprising:

a developer carrier, spaced apart from an image carrier at a predetermined interval, for developing an electrostatic latent image formed on the image carrier during rotation;

a rotational member, rotatably installed adjacent to the image carrier, for generating an air stream reverse to that generated by rotation of both the image carrier and the developer carrier;

a first housing where the developer carrier is installed and a new developer is contained;

a second housing where the image carrier is rotatably supported and a waste developer is contained, wherein the scattered developer container is rotatably disposed on an outer side of the first housing; and a scattered developer container for containing a scattered developer shifted by the air stream generated by rotation of the rotational member;

wherein the scattered developer container includes a third housing installed on a lower side of the first housing and is provided with an inlet and an outlet.

36. The developing apparatus as claimed in claim 35, wherein the outlet of the third housing is provided with a filter.

37. The developing apparatus as claimed in claim 35, wherein the scattered developer container further includes a developer scattering inhibitor for inhibiting the developer introduced into the inlet of the third housing from flowing out to the outlet and storing the inhibited developer.

38. The developing apparatus as claimed in claim 37, wherein the developer scattering inhibitor includes at least one adhesive layer provided on an inner wall of the third housing.

39. The developing apparatus as claimed in claim 37, wherein the developer scattering inhibitor includes a slant surface inclined upward from a bottom surface of the third housing to the outlet.

40. The developing apparatus as claimed in claim 37, wherein the scattered developer container further includes a plate member supported to the third housing, the plate member being installed around a lower portion of the rotational member and being resiliently deformable.

41. The developing apparatus as claimed in claim 40, wherein the plate member is a film formed of polyethylene terephthalate (PET) or urethane.

42. The developing apparatus as claimed in claim 40, wherein the plate member is spaced apart from the rotational member at an interval ranging from about 0 mm to about 3 mm.

43. The developing apparatus as claimed in claim 40, wherein the plate member has a length extending from the third housing, the length being greater than a radius of the rotational member.

* * * * *